United States Patent [19]

Schröder

[11] Patent Number: 4,730,529

[45] Date of Patent: Mar. 15, 1988

[54] CUTTING AND GROOVING DEVICE FOR PAPER AND CARDBOARD WEBS

[75] Inventor: Lothar Schröder, Elmshorn, Fed. Rep. of Germany

[73] Assignee: Peters Maschinenfabrik GmbH, Fed. Rep. of Germany

[21] Appl. No.: 905,546

[22] Filed: Sep. 10, 1986

[30] Foreign Application Priority Data

Oct. 3, 1985 [DE] Fed. Rep. of Germany ..... 3535265

[51] Int. Cl.[4] ..... B26D 7/06

[52] U.S. Cl. ..... 83/425.4; 83/477.1; 83/498; 83/504; 83/575; 83/577; 83/699

[58] Field of Search ..... 83/425.4, 425.3, 477, 83/504, 508.2, 508.3, 498, 499, 507, 575, 577, 664, , 663, 665, 666, 676, 679, 698, 699, 700; 403/1, DIG. 1; 407/35, 38; 279/1 M; 51/362, 168, 24, 134.5 R

[56] References Cited

U.S. PATENT DOCUMENTS 3,073,198 1/1963 Clem ..... 83/504

3,961,547 6/1976 Shainberg et al. ..... 83/425.4

*Primary Examiner*—Frank T. Yost

*Assistant Examiner*—Scott A. Smith

*Attorney, Agent, or Firm*—Harness, Dickey & Pierce

[57] ABSTRACT

A cutting or grooving device for paper or cardboard webs, comprising at least two rotatably driven shafts having at least one tool carrier for a cutting or grooving tool arranged thereon, the tool carrier having at least one radially movable chuck adapted to be brought into engagement with the shaft, and an actuating device for the chuck adapted to be controlled from outside the shaft, the chuck being actuable magnetically via a current supply.

7 Claims, 3 Drawing Figures

CUTTING AND GROOVING DEVICE FOR PAPER AND CARDBOARD WEBS

BACKGROUND OF THE INVENTION

The invention relates to a cutting and grooving device for paper and cardboard webs, comprising at least two rotatably driven shafts with at least one tool carrier for a cutting or grooving tool arranged thereon, said tool carrier comprising at least one radially movable chuck adapted to be engaged with the shaft, and an actuating device for the chuck controllable from outside the shaft.

Machines for longitudinally cutting and longitudinally grooving paper or cardboard webs normally comprise at least one pair of rolls with annularly shaped cutting or grooving tools, in order to cut or groove the web passing through in a longitudinal direction. Dependant respectively on the order to be carried out, the position of the tools on the shafts must be newly adjusted. For this purpose, the tools are adapted to be clamped onto the shafts and to be disengaged again in case of necessity. So that an adjustment of the tools may be performed as quickly as possible, it is aimed at carrying out the disengagement and clamping of the tools automatically and without any manual operation. In this connection it is known to design the shafts as so-called expanding shafts which may be radially enlarged with the aid of a pressure medium in order to tightly clamp the tools (German disclosure letter No. 2 250 508). It is also known to arrange expandable hoses in grooves of the tool shafts, in order to tightly clamp the tools. The grooves are extending either annularly or helically. Such a process has proved to be absolutely useful. What is disadvantageous, however, is the wear.

It has furthermore become known to arrange several chucks in the tool carrier and bring the chucks into engagement with the shafts with the aid of one or several pressure hoses (German disclosure letter No. 2 059 970). What is disadvantageous with the known device is the manner of compressed air supply as well as the control of the compressed air supply and discharge thereof when clamping and disengaging the shaft.

It is therefore the object of the invention to improve the cutting and grooving device mentioned at the beginning in such a manner that the cutting and/or grooving tools may be tightly clamped on a shaft and disengaged again in an especially simple manner.

SUMMARY OF THE INVENTION

The above object is attained in accordance with the invention in that the chuck is adapted to be actuated magnetically via a current supply means. Preferably, several magnetically actuated chucks are employed which are arranged radially and equally spaced circumferentially. The chuck may on its part be designed to be magnetic. Alternatively, the chuck may be adapted to be actuated by an electromagnet. What is essential to the invention is that the power of actuation for clamping a tool onto the shaft is applied electromagnetically. For this purpose, a current supply is needed to the individual chucks. Said current, however may be easily transferred to the movable shaft via slip rings. One embodiment of the invention provides in this connection that two current-collecting rails are rotating together with a shaft and each tool carrier is movable in an axial direction relative to the current-collecting rails and is insulated with respect to the current-collecting rails and is provided with two spring-biased contact elements which are in contact with the current-collecting rails. The current-collecting rails are rotating with the shaft and are extending through openings and recesses, respectively, of the tool carriers. As a result, the tool carriers may be displaced on the shaft unobstructedly. The current-collecting rails may also be countersunk in the shaft. The contact elements such as carbon brushes, for example, are in permanent contact with the current-collecting rails, in order to transfer the current from the current-collecting rails to the individual magnetic arrangements in the chucks. The current-collecting rails may be connected at one end thereof to a slip ring arrangement. It goes without saying that the shaft itself may be used as a mass conductor, so that one current-collecting rail is in conductive contact with the shaft. Another possibility consists in that a movable contact is associated with each tool carrier instead of a current-collecting rail, said contact being in permanent engagement with the shaft and being connected to the individual magnetic arrangements in the chucks via a line. In this case, only one current-collecting rail is utilized.

What is especially advantageous is to associate springs with the chucks. One possibility consists in that the chucks are biased radially away from the shaft with the aid of said springs, in order to obtain a quick disengagement of the tool carrier from the shaft when the magnetic excitation is switched off. According to another embodiment of the invention the chucks are biased in a direction towards the shaft by means of a spring arrangement. The springs take care of the clamping of the tools onto the shaft, while the magnetic acutation is made use of only for a temporary disengagement of the tools.

Expenditure caused by mechanical means for the tool carriers and the current supply as well as control means for actuating the electromagnetically biased chucks is exremely low. Apart from the easily replaceable carbon brushes in a slip ring type transfer, wear occurring with the known arrangement is next to zero. The transit time for disengaging or clamping the tools on the shaft is not greater than with expanding shafts or similar devices.

BRIEF DESCRIPTION OF THE DRAWINGS

The invention will be explained in the following in more detail by way of drawings.

DETAILED DESCRIPTION OF THE PREFERRED EMBODIMENTS OF THE INVENTION

Figure 1:
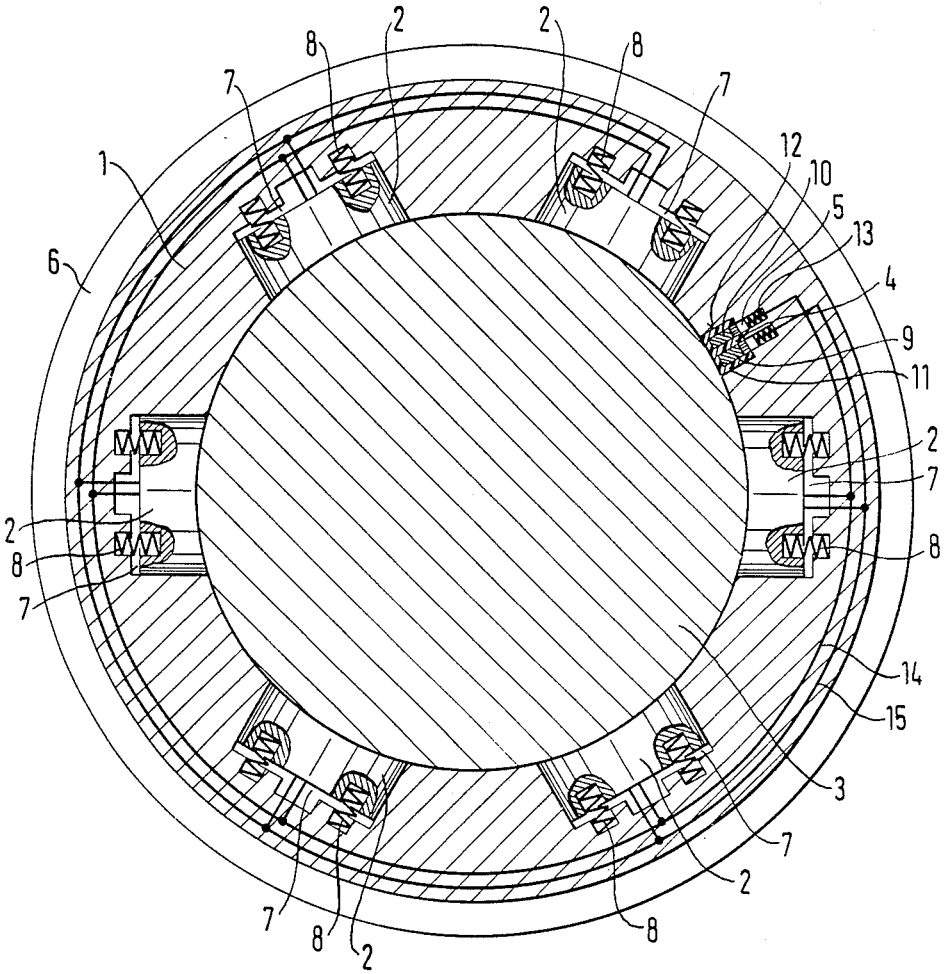
FIG. 1 shows a sectional view of a tool carrier on a tool shaft according to the invention in an extremely diagrammatic representation.

Referring first to the embodiment of FIG. 1, seated on a shaft 3 of a longitudinal cutting and grooving device for paper or cardboard webs is an annular tool carrier 1 for a cutting tool 6, for example. As is well known with such devices, pairs of shafts are employed. Seated on the second shaft is a counter tool for a cutting or grooving tool. Both shafts are rotated by means of a suitable driving device.

Six radial recesses 7 are formed in the tool carrier 1 from the inner circumference thereof, each having a chuck 2 movably supported therein. The chucks 2 are suitably shaped to meet the recesses but may be adjusted radially in a limited extent without causing much expenditure. On the radially inner surface the chucks are adapted to the contour of the shaft 3. Each chuck 2 is biased by springs 8 urging the chucks into engagement with the circumference of the shaft 3. Thereby, the tool carrier 1 is tightly clamped onto the shaft 3. The chucks are furthermore actuable by a magnetic actuating means not shown, i.e. in such a manner that upon excitation of the magnetic arrangement the chucks 2 are adjusted radially away from the shaft 3 against the springs 8. Owing thereto, the tool carrier 1 may be displaced freely on the shaft 3.

Rotating with the shaft 3 are two current-collecting rails 9, 10, which are separated from each other by means of an insulation 4. Both rails 9, 10 as well as an insulation 11 on both sides of the rails 9, 10 are accommodated in a groove 12 of the tool carrier 1. The rails 9, 10 are, besides, electrically insulated also with respect to the shaft 3. Brushes 5 are in contact with the rails while being biased by springs 13. Respectively connected to the brushes 5 are lines 14 and 15, respectively, which are leading to the individual magnetic arrangements of the chucks 2. The current-collecting rails 9, 10 are in engagement with stationary slip rings (not shown in FIG. 1), so that the current may be transferred onto the magnetic arrangements in the chucks 2 from the stationary current source.

It goes without saying that the shaft 3 may be used as a mass conductor. In that case, one of the two current-collecting rails 9, 10 may be electrically connected to the shaft 3. Alternatively, each tool carrier 1 may have associated thereto a movable contact instead of one of the two current-collecting rails 9, 10, said movable contact being in conductive engagement with the shaft 3. In all the cases, care is taken that the tool carrier may be adjusted unobstructedly in the direction of the axis of the shaft 3. In the direction of rotation, on the contrary, the tool carrier 1 is fixed by the current-collecting rails 9, 10.

If, instead of the springs 8, springs are employed which are effective in an opposite direction, the system shown may likewise be used in an advantageous manner. In this case the springs are serving the purpose of overcoming the remanence of magnetism possibly present when disengaging the tool carrier.

Besides, it is advantageous when the chucks are movable radially by a certain extent as is represented in the drawing. It is possible in this manner to balance different transverse stresses on the tool.

Figure 3:
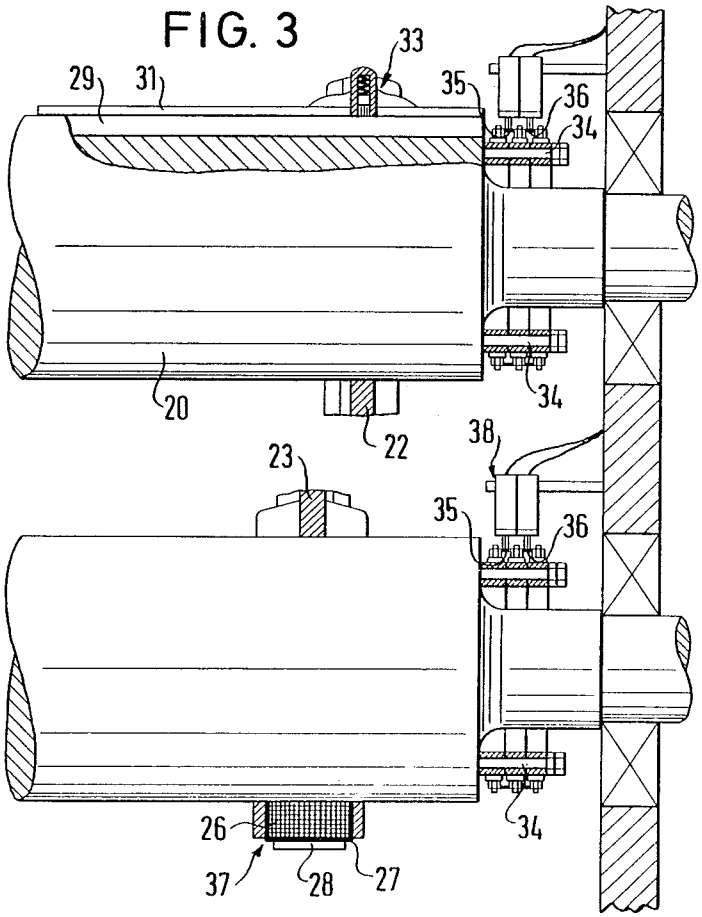
FIG. 3 shows a sectional view of the arrangement according to FIG. 2 taken along line 3—3.
Figure 2:
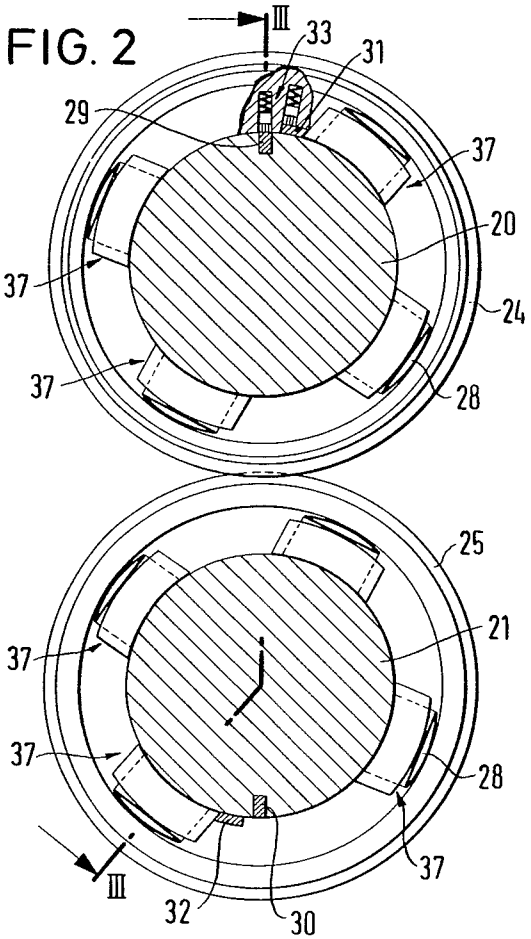
FIG. 2 shows a sectional view of two tool shafts with cooperating tools on tool carriers in accordance with another embodiment of the invention.

In the embodiments according to FIGS. 2 and 3, two tool shafts 20, 21 are provided having several tool carriers with tools arranged thereon. However, only one upper tool carrier 22 and one lower tool carrier 23 are shown in the drawing. They comprise, as shown in FIG. 2, an upper knife 24 and a lower knife 25, respectively, which are cooperating with each other in a manner known per se. The upper and lower tool carriers 22, 23 each comprise four equally circumferentially spaced magnetic arrangements 37. As may be seen from FIG. 3, each magnetic arrangement comprises a sticking magnet 26, which is slidably supported in a suitable housing of the tool carrier 22 and 23, respectively, by means of a rubber sleeve 27. Arranged on the side facing away from the tool shaft is a flat rubber spring 28 urging the sticking magnet 26 against the shaft 21 with a certain pressure. Current-collecting rails 29 and 30, respectively, are disposed in a groove of the shafts 20, 21 in insulated arrangement. A further current-collecting rail 31, 32 is arranged on the shaft 20 and 21, respectively, adjacent a magnetic arrangement 37. Each tool carrier 22 and 23, respectively, comprises a brush arrangement 33 with brushes cooperating with the current-collecting rails 29 to 32. The arrangement of brushes is connected to each magnetic arrangement 37, which is not shown in FIGS. 2 and 3.

Two slip rings 35, 36 are fastened at the shaft 20 and 21, respectively, in an insulated manner by means of retaining bolts 34. The slip rings 35, 36 are connected to the current-collecting rails 29 to 32 via conduits (not shown). Cooperating with the slip rings 34, 35 is an arrangement of brushes 36, the brushes of which are connected to conductors connected to a voltage source of 24 volts. It is possible with the aid of the current supply as shown and described to respectively excite and switch off the magnetic arrangements 37 in the individual tool carriers 22, 23. Upon excitation, the sticking magnets 26 will exert a pressure against the shafts 20 and 21, respectively, in order to fix the tool carriers at the shaft. Upon positioning the tool carriers, the magnets are de-energized.

I claim:

1. A cutting and grooving device for paper or cardboard webs, comprising at least two rotatably driven shafts each having at least one tool carrier for a tool arranged for sliding movement thereon, said tool carrier having at least one radially movable chuck adapted to be brought into clamping engagement with the respective shaft for locking said tool carrier in an adjusted position relative to the associated shaft, and an actuating device adapted to be controlled from outside the shaft for the chuck, characterized in that the chuck is electromagnetically actuable via a current supply means extending along said shaft for remote actuation of said electromagnetic chuck.

2. A device according to claim 1, characterized in that the chuck comprises a magnet armature.

3. A device according to claim 1, characterized in that a series of magnetically actuable chucks are arranged radially in equally spaced circumferential arrangement in the tool carrier.

4. A device according to claim 3, characterized in that the tool carrier comprises an annular section having radial recesses at the inner surface thereof with the chucks supported therein for radial movement.

5. A device according to claim 1, characterized in that the chucks are biased in the direction of the shaft by means of a spring arrangement.

6. A device according to claim 1, characterized in that the chucks are biased in a direction away from the shaft by means of a spring arrangement.

7. A device according to claim 1, characterized in that at least one current-collecting rail rotated with the shaft and each tool carrier is relatively movable with respect to the current-collecting rail in an axial direction and is insulated from the current-collecting rail and comprises a spring-biased contact element in engagement with the current-collecting rail.

* * * * *